US008177315B2

(12) United States Patent
Endo et al.

(10) Patent No.: US 8,177,315 B2
(45) Date of Patent: May 15, 2012

(54) PRINTING APPARATUS AND METHOD OF CONTROLLING THE SAME

(75) Inventors: Hironori Endo, Okaya (JP); Shinya Komatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 875 days.

(21) Appl. No.: 12/201,749

(22) Filed: Aug. 29, 2008

(65) Prior Publication Data

US 2009/0058920 A1 Mar. 5, 2009

(30) Foreign Application Priority Data

Aug. 31, 2007 (JP) ..... 2007-227160

(51) Int. Cl.
*B41J 29/38* (2006.01)

(52) U.S. Cl. ..... 347/14; 347/23; 347/33

(58) Field of Classification Search ..... 347/15, 347/14, 19, 23, 33
See application file for complete search history.

(56) References Cited

U.S. PATENT DOCUMENTS

| | | | | |
|---|---|---|---|---|
| 7,186,448 | B2 | 3/2007 | Yokoyama et al. | |
| 2002/0171699 | A1* | 11/2002 | Choi | 347/19 |
| 2004/0056915 | A1* | 3/2004 | Miyazawa | 347/19 |
| 2006/0066660 | A1* | 3/2006 | Johnson | 347/20 |

FOREIGN PATENT DOCUMENTS

| | | | |
|---|---|---|---|
| JP | 07-327124 | A | 12/1995 |
| JP | 2002-283672 | | 10/2002 |
| JP | 2004-079663 | A | 3/2004 |
| JP | 2004-230640 | A | 8/2004 |

* cited by examiner

*Primary Examiner* — Laura Martin
(74) *Attorney, Agent, or Firm* — Maschoff Gilmore & Israelsen

(57) ABSTRACT

A printing apparatus includes an ejection unit that ejects fluid from nozzles onto a target and a nozzle inspection unit that performs nozzle inspection to inspect whether the fluid is ejected. An automatic print setting unit sets a check pattern automatic print mode in which a check pattern for confirming whether the fluid is ejected from the nozzles. An automatic inspection setting unit, when a predetermined automatic inspection condition is established, sets an automatic nozzle inspection mode in which the nozzle inspection is performed. A cleaning unit performs nozzle cleaning to clean abnormal nozzles that are detected. When the automatic nozzle inspection mode is set, a control unit controls the nozzle inspection unit so as not to perform the nozzle inspection during a period from when one of printing based on the print data and printing of the check pattern is started until the other is finished.

20 Claims, 9 Drawing Sheets

TRANSPORT DIRECTION (○ NOZZLE INSPECTION ROUTINE IS EXECUTED  × NOZZLE INSPECTION ROUTINE IS NOT EXECUTED)

PRINTING APPARATUS AND METHOD OF CONTROLLING THE SAME

BACKGROUND

1. Technical Field

The present invention relates to a printing apparatus and a method of controlling the same.

2. Related Art

There is known a printing apparatus that, when a nozzle check button is pushed on a utility screen of application software running on a computer, prints a nozzle check pattern, and when a cleaning button is pushed on the screen, performs head cleaning (for example, see JP-A-2002-283672).

At predetermined timings, for example, each time the number of print jobs exceeds a predetermined number or a predetermined time elapses, automatic nozzle check may be performed with no check pattern printed, and if necessary, nozzle cleaning may be performed. However, in the printing apparatus disclosed in JP-A-2002-283672, such a process is not taken into consideration. Specifically, when a predetermined timing comes, for example, even if a user pushes the nozzle check button so as to check the current state of nozzles, cleaning may be performed before then. That is, unintended nozzle check or nozzle cleaning may be performed.

SUMMARY

An advantage of some aspects of the invention is that it provides a printing apparatus capable of printing a check pattern, from which information according to a user's intention is obtained, and a method of controlling a printing apparatus.

Some aspects of the invention are provided in the following manner.

According to an aspect of the invention, a printing apparatus includes an ejection unit that ejects a fluid from nozzles onto a target, a nozzle inspection unit that performs nozzle inspection to inspect whether or not the fluid is ejected from the nozzles, an automatic print setting unit that, when printing based on print data to be printed is performed, sets a check pattern automatic print mode in which a check pattern for confirming whether or not the fluid is ejected from the nozzles is printed, together with the print data, an automatic inspection setting unit that, when a predetermined automatic inspection condition is established, sets an automatic nozzle inspection mode in which the nozzle inspection is performed, a cleaning unit that, when the result of the nozzle inspection indicates that there is an abnormal nozzle, performs nozzle cleaning to clean the nozzles, and a control unit that, when the automatic nozzle inspection mode is set, if the automatic inspection condition is established while printing based on the print data is being performed in the check pattern automatic print mode, controls the nozzle inspection unit so as not to perform the nozzle inspection during a period from when one of printing based on the print data and printing of the check pattern is started until the other is finished.

With this printing apparatus, when the result of a nozzle inspection as to whether or not a fluid is ejected from nozzles indicates that there is an abnormal nozzle, nozzle cleaning is performed to clean the nozzle. And, when an automatic nozzle inspection mode in which the nozzle inspection is performed is set while a predetermined automatic inspection condition is established, if the automatic inspection condition is established while printing based on print data is performed when a check pattern automatic print mode is set in which, when printing based on the print data is performed, a check pattern for confirming whether or not the fluid is ejected from the nozzles is printed, together with the print data, the nozzle inspection is not performed during the period from when one of printing based on the print data and printing of the check pattern is started until the other is finished. As such, even if the automatic nozzle inspection mode is set, when the check pattern automatic print mode is set, the check pattern is printed with no nozzle inspection, in which the nozzle cleaning may be performed, during the period from when one of printing based on the print data and printing of the check pattern is started until the other is finished. For this reason, at the beginning or end of printing based on the print data, the check pattern is printed with the nozzle states reflected. Therefore, it is possible to print a check pattern, from which information according to a user's intention is obtained. The term "predetermined automatic inspection condition" used herein may be established, for example, each time an empirically determined time at which the fluid may not be ejected from the nozzles elapses, each time an empirically determined number of jobs in which the fluid may not be ejected from the nozzles are processed, each time an empirically determined number of pages in which the fluid may not be ejected from the nozzles are processed, or each time an empirically determined number of print passes in which the fluid may not be ejected from the nozzles are processed. Printing of the check pattern may be performed after or before printing based on the print data.

In the printing apparatus according to the aspect of the invention, when the automatic nozzle inspection mode is set, and when the check pattern automatic print mode is set while printing based on the print data is performed, if printing of the check pattern is to be performed before printing based on the print data, the control unit may control the nozzle inspection unit so as to perform the nozzle inspection before printing of the check pattern. With this configuration, with no nozzle that does not eject the fluid, printing is performed on the basis of the print data after the check pattern is printed. Therefore, it is possible to print a check pattern ensuring that an image at the beginning of printing based on the print data is an image with no nozzle not ejecting the fluid.

In the printing apparatus according to the aspect of the invention, when the automatic nozzle inspection mode is set, and when the check pattern automatic print mode is set while printing based on the print data is performed, if printing of the check pattern is to be performed after printing based on the print data, the control unit may control the nozzle inspection unit so as to perform the nozzle inspection before printing based on the print data. With this configuration, with no nozzle that does not eject the fluid, printing based on the print data is started. Therefore, an image at the beginning of printing based on the print data can be regarded as an image with no nozzle not ejecting the fluid.

In the printing apparatus according to the aspect of the invention, when printing based on the print data is to be performed in a state in which the automatic nozzle inspection mode is set, and when a predetermined midstream inspection condition is established while print data consisting of multiple pages is printed, if printing of the check pattern is to be performed before printing based on the print data, the control unit may control the ejection unit so as to pause printing at a point of time at which printing of a page being printed is completed and control the nozzle inspection unit so as to perform the nozzle inspection, and subsequently control the ejection unit so as to print the check pattern and to resume printing based on the print data. If printing of the check pattern is to be performed after printing based on the print data, the control unit may control the ejection unit so as to print the check pattern after printing of the page being printed is completed, then control the ejection unit so as to pause printing at a point of time at which the check pattern is printed and control the nozzle inspection unit so as to perform the nozzle inspection, and subsequently control the ejection unit so as to resume printing based on the print data and print the check pattern. With this configuration, when printing based on print data consisting of multiple pages is performed, it is possible to reduce the number of pages to be printed in a state in which a nozzle not capable of ejecting the fluid occurs. The term "predetermined midstream inspection condition is established" refers to, for example, each time an empirically determined number of pages in which the fluid may not be ejected from the nozzles are printed, each time an empirically determined time at which the fluid may not be ejected from the nozzles elapses, or each time an empirically determined number of print passes in which the fluid may not be ejected from the nozzles are processed.

In the printing apparatus according to the aspect of the invention, the automatic print setting unit may set, as the check pattern automatic print mode, a mode in which, when printing based on the print data is to be performed, the check pattern is printed before or after the print data, together with the print data. With this configuration, it is possible to print a check pattern with the nozzle state immediately before or after printing based on the print data.

In the printing apparatus according to the aspect of the invention, the check pattern may be a pattern that enables visual confirmation of whether or not the fluid is ejected. With this configuration, a user can confirm with his/her eyes whether or not the fluid is ejected.

The printing apparatus according to the aspect of the invention may further include an instruction input unit that inputs a check pattern print instruction for printing the check pattern. In this case, when the automatic nozzle inspection mode is set, if the check pattern print instruction is input and printing of the check pattern is performed separately from printing based on the print data, the nozzle inspection unit may be controlled so as not to perform the nozzle inspection even if the automatic inspection condition is established during a period from when the check pattern print instruction is input until the check pattern is printed. With this configuration, even if the automatic nozzle inspection mode is set, when the check pattern print instruction is input, the check pattern is printed with no nozzle inspection in which nozzle cleaning may be performed. Therefore, a check pattern having reflected therein the nozzle states at that time is printed. As a result, it is possible to print a check pattern, from which information according to a user's intention is obtained.

In the printing apparatus according to the aspect of the invention, the nozzle inspect unit may include a voltage application unit that applies a predetermined voltage to a fluid receiving area where the fluid ejected from the nozzles is received and between the ejection unit and the fluid receiving area, and an electrical change detection unit that detects an electrical change in the ejection unit or the fluid receiving area. In this case, the control unit may control the nozzle inspection unit so as to perform the nozzle inspection, or may control the ejection unit so as to sequentially eject the fluid from the nozzles onto the fluid receiving area in a state in which the voltage application voltage applies the predetermined voltage between the ejection unit and the fluid receiving area, and on the basis of the electrical change detected by the electrical change detection unit, perform the nozzle inspection as to whether or not the fluid is ejected from the nozzles. With this configuration, it is possible to perform the nozzle inspection without performing printing. Alternatively, the nozzle inspection unit may include a fluid receiving area where the fluid ejected from the nozzles is received, a light emitting unit that emits light beams, and a light receiving unit that receives the light beams. In this case, the control unit may control the nozzle inspection unit so as to perform the nozzle inspection, or may control the ejection unit so as to sequentially eject the fluid from the nozzles onto the fluid receiving area in a state in which light beams in a direction intersecting to an ejection direction of the fluid are emitted from the light emitting unit toward the light receiving unit between the ejection unit and the fluid receiving area, and on the basis of a change in the amount of light received by the light receiving unit, determine whether or not the light beams are shielded by ejected ink, to thereby perform the nozzle inspection as to whether or not the fluid is ejected from the nozzles. With this configuration, it is possible to perform the nozzle inspection without performing printing.

According to another aspect of the invention, there is provided a method of controlling a printing apparatus, which includes an ejection unit for ejecting a fluid from nozzles onto a target, by using computer software. The method includes, when the result of a nozzle inspection as to whether or not the fluid is ejected from the nozzles indicates that there is an abnormal nozzle, performing nozzle cleaning to clean the nozzles, and when an automatic nozzle inspection mode in which the nozzle inspection is performed is set while a predetermined automatic inspection condition is established, if the automatic inspection condition is established while printing based on print data is being performed when a check pattern automatic print mode is set in which, when printing based on the print data is performed, a check pattern for confirming whether or not the fluid is ejected from the nozzles is printed, together with the print data, controlling such that the nozzle inspection is not performed during the period from when one of printing based on the print data and printing of the check pattern is started until the other is finished.

With this method, when the result of a nozzle inspection as to whether or not a fluid is ejected from nozzles indicates that there is an abnormal nozzle, nozzle cleaning is performed to clean the nozzle. And, when an automatic nozzle inspection mode in which the nozzle inspection is performed is set while a predetermined automatic inspection condition is established, if the automatic inspection condition is established while printing based on print data is being performed when a check pattern automatic print mode is set in which, when printing based on the print data is performed, a check pattern for confirming whether or not the fluid is ejected from the nozzles is printed, together with the print data, the nozzle inspection is not performed during the period from when one of printing based on the print data and printing of the check pattern is started until the other is finished. As such, even if the automatic nozzle inspection mode is set, when the check pattern automatic print mode is set, the check pattern is printed with no nozzle inspection, in which the nozzle cleaning may be performed, during the period from when one of printing based on the print data and printing of the check pattern is started until the other is finished. For this reason, at the beginning or end of printing based on the print data, the check pattern is printed with the nozzle states reflected. Therefore, it is possible to print a check pattern, from which information according to a user's intention is obtained. The method may further include the steps for implementing the functions of the printing apparatus. The invention may be implemented as a program for causing one or a plurality of computers to execute the method.

BRIEF DESCRIPTION OF THE DRAWINGS

The invention will be described with reference to the accompanying drawings, wherein like numbers reference like elements.

DESCRIPTION OF EXEMPLARY EMBODIMENT

Figure 1:
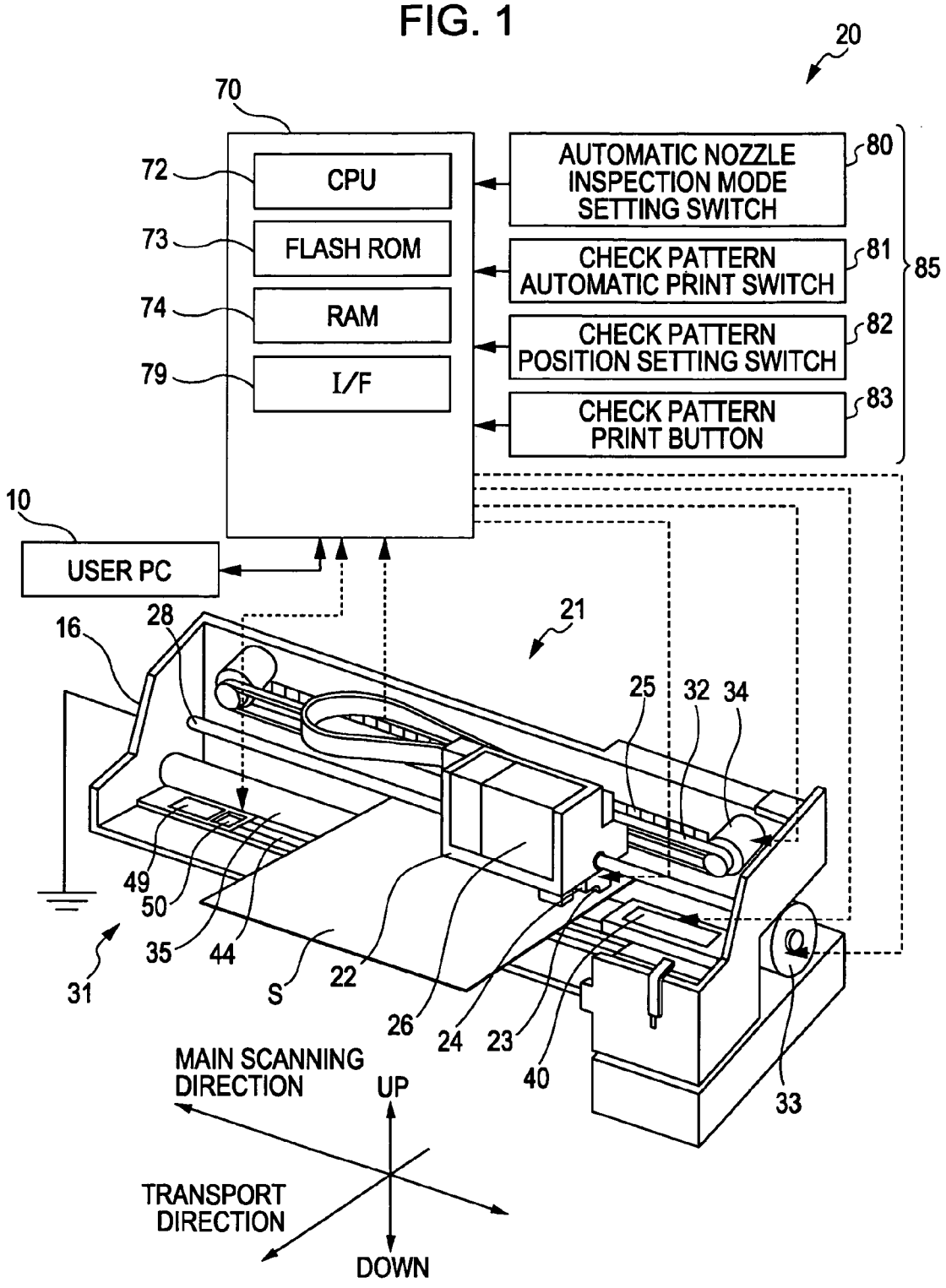
FIG. 1 is a diagram showing the schematic configuration of a printer 20.
Figure 2:
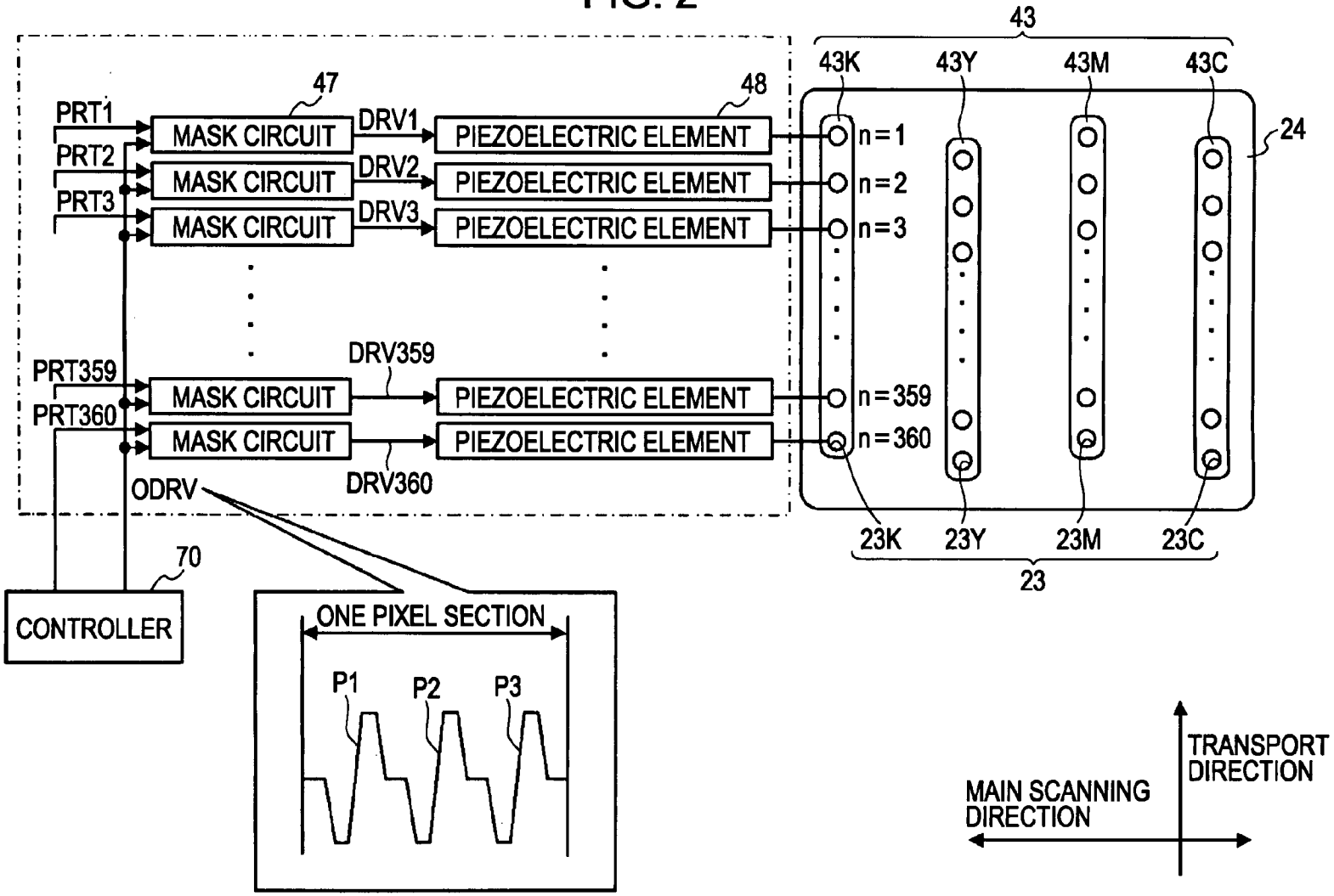
FIG. 2 is an explanatory view of a print head 24.
Figure 3:
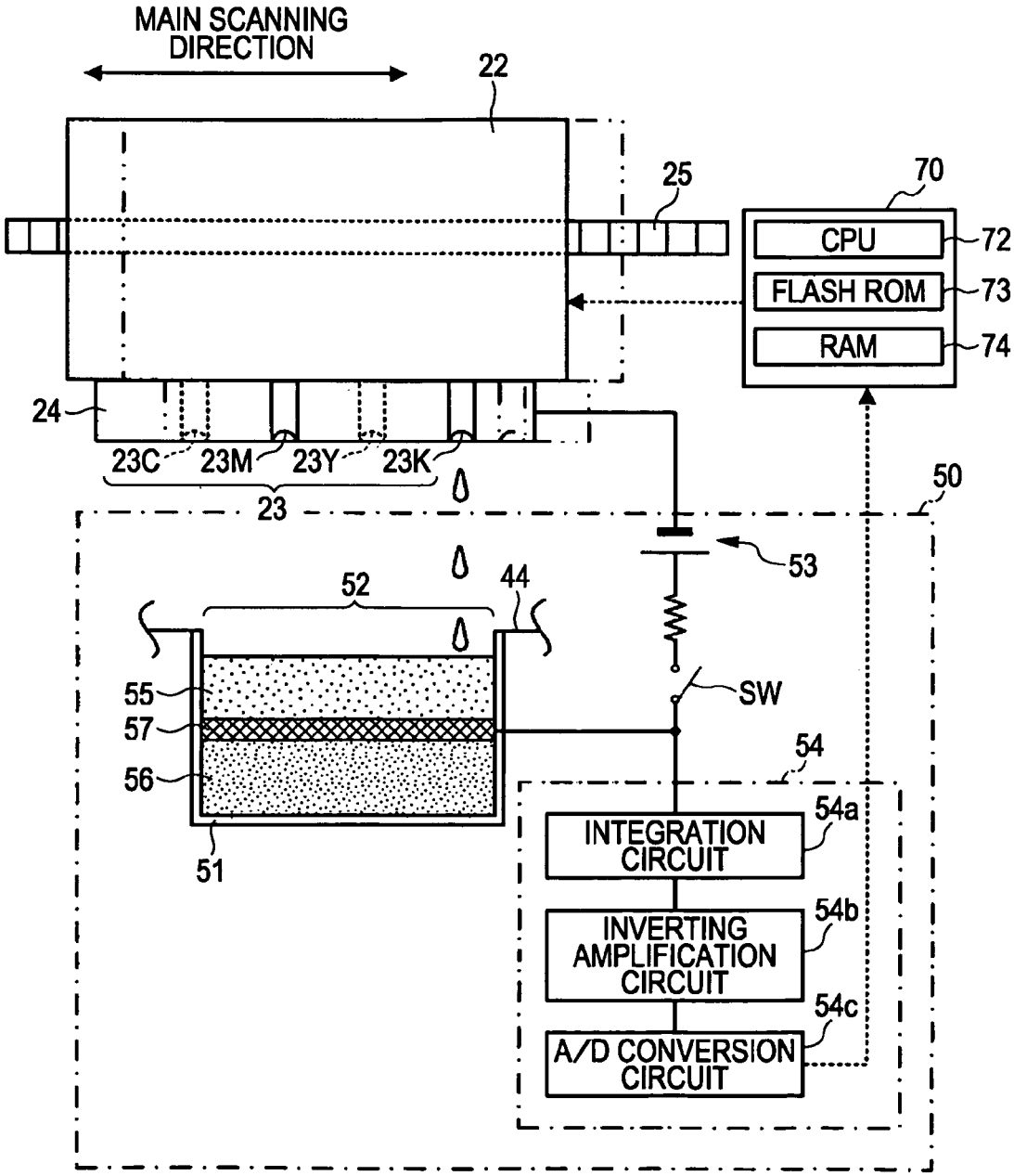
FIG. 3 is a diagram showing the schematic configuration of a nozzle inspection device 50.
Figure 4A:
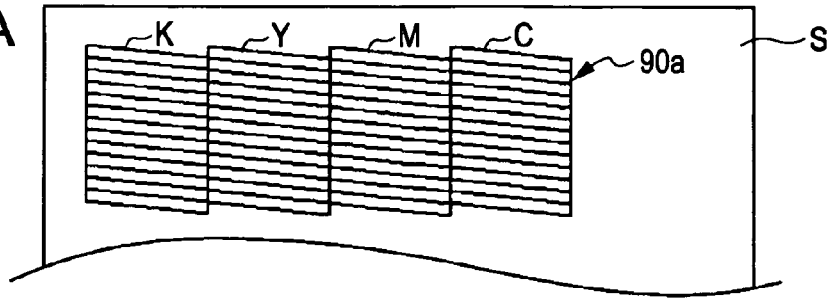
FIG. 4A is an explanatory view of an example of a check pattern 90*a*.
Figure 4B:
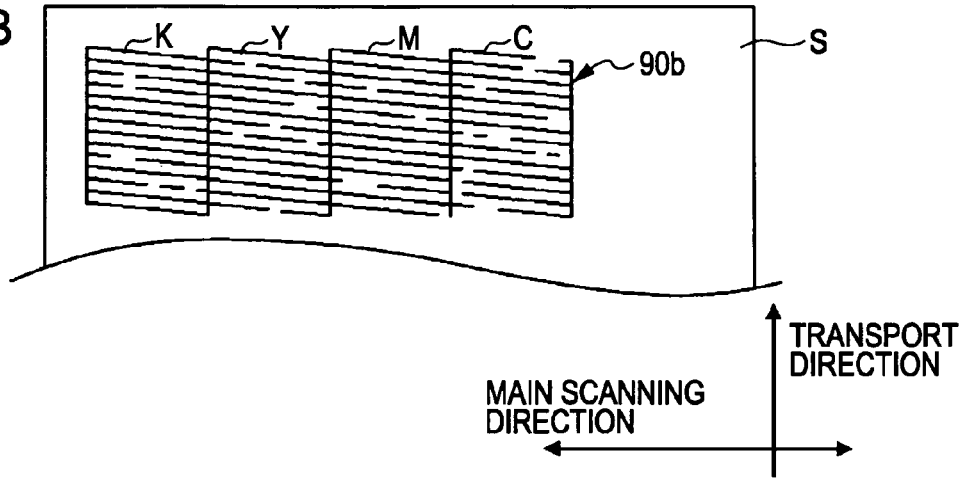
FIG. 4B is an explanatory view of an example of a check pattern 90*b*.

Next, an exemplary embodiment of the invention will be described with reference to the drawings. FIG. 1 is a diagram showing the schematic configuration of a printer 20 according to an embodiment of the invention. FIG. 2 is an explanatory view of a print head 24. FIG. 3 is a diagram showing the schematic configuration of a nozzle inspection device 50. FIGS. 4A and 4B are explanatory views of check patterns 90*a* and 90*b*, which are examples of a check pattern to be printed on a recording sheet S, respectively. The check pattern with the nozzle states reflected enables a user to confirm whether or not ink is ejected.

The printer 20 of this embodiment includes, as shown in FIG. 1, a printer mechanism 21 that includes a print head 24, a carriage 22, and the like, a sheet feed mechanism 31 that includes a sheet feed roller 35 to be driven by a drive motor 33 and feeds a recording sheet S in a transport direction, a capping device 40 that is provided near a right end of a platen 44 in FIG. 1, a nozzle inspection device 50 that is provided adjacent to a flushing area 42 above the platen 44 and performs a nozzle inspection as to whether or not ink droplets can be ejected from nozzles 23 of the print head 24, buttons 85 through which the user inputs various instructions, and a controller 70 that controls the overall printer 20.

The printer mechanism 21 includes a carriage 22 that reciprocates in a horizontal direction (main scanning direction) along a guide 28 by means of a carriage belt 32 and a carriage motor 34, ink cartridges 26 that are mounted on the carriage 22 and respectively contain ink of colors of yellow (Y), magenta (M), cyan (c), and black (K), a print head 24 that applies pressure to ink supplied from the respective ink cartridges 26, nozzles 23 that serve as ejection holes for ejecting the ink droplets pressurized by the print head 24 onto the recording sheet S, and a platen 44 that serves as a support member for supporting the recording sheet S being printed. Around the carriage 22, a linear-type encoder 25 is disposed to detect the position of the carriage 22. The use of the linear-type encoder 25 enables the position of the carriage 22 to be managed. Though not shown, the ink cartridges 26 are constructed as containers that respectively contain ink for printing, such as cyan (C), magenta (M), yellow (Y), and black (K) in which a colorant, such as a pigment or a dye, is mixed in water serving as a solvent, and are detachably mounted on the carriage 22. At a left end of the platen 44 outside of a printable area, a flushing area 42 is formed. The flushing area 42 is used to perform a so-called flushing operation to eject the ink droplets regularly or at a predetermined timing, regardless of print data, so as to prevent ink from being dried and solidified at the front end of each nozzle 23.

Many components (the carriage 22 and the like) of the printer mechanism 21 are well known, and thus the detailed descriptions thereof will be omitted. Hereinafter, only the print head 24 closely associated with the invention will be described. The print head 24 is provided with, as shown in FIG. 2, a nozzle array 43 having arranged therein a plurality of nozzles 23 for ejecting ink of the respective colors of cyan (C), magenta (M), yellow (Y), and black (K). Herein, all nozzles are collectively referred to as nozzles 23, and all nozzle arrays are collectively referred to as nozzle arrays 43. Nozzles of cyan ink and a nozzle array of cyan are referred to as nozzles 23C and a nozzle array 43C, respectively, and nozzles of magenta ink and a nozzle array of magenta are referred to as nozzles 23M and a nozzle array 43M, respectively. Nozzles of yellow ink and a nozzle array of yellow are referred to as nozzles 23Y and a nozzle array 43Y, respectively, and nozzles of black ink and a nozzle array of black are referred to as nozzles 23K and a nozzle array 43K. The nozzle arrays are disposed in zigzag manner with a shift by a half pitch. In the following description, the nozzles 23K will be used as an example. In the print head 24, 360 nozzles 23K are arranged in the transport direction of the recording sheet S and constitute the nozzle array 43K. The nozzle 23K has a piezoelectric element 48 that serves as a drive element for ejecting the ink droplets. Application of a voltage to the piezoelectric element 48 deforms the piezoelectric element 48 and pressurizes ink, and thus ink is ejected from the nozzle 23K.

The print head 24 includes a plurality of mask circuits 47 that are provided to correspond to a plurality of piezoelectric elements 48 for respectively driving the nozzles 23K. An original signal ODRV or a print signal PRTn which is generated in the controller 70 is input to the mask circuits 47. The character n at the end of the print signal PRTn is a number which is used to specify a nozzle in the nozzle array. In this embodiment, since the nozzle array includes 360 nozzles, n may be an integer between 1 and 360. As shown in the lower part of FIG. 2, the original signal ODRV has three drive waveforms of a first pulse P1, a second pulse P2, and a third pulse P3 in one pixel section (within a time in which the carriage 22 traverses a spacing of one pixel). In this embodiment, as one segment, the original signal ODRV having the three drive waveforms is described as a unit of repetition. If the original signal ODRV or the print signal PRTn is input, the mask circuit 47 outputs to the piezoelectric element 48 of the nozzle 23K a required pulse from among the first pulse P1, the second pulse P2, and the third pulse P3 as a drive signal DRVn ("n" means the same as that of the print signal PRTn) on the basis of the input signal. Specifically, if only the first pulse P1 is output from the mask circuit 47 to the piezoelectric element 48, one shot of ink droplets is ejected from the nozzle 23K, and thus a small-sized dot (a small dot) is formed on the recording sheet S. If the first pulse P1 and the second pulse P2 are output to the piezoelectric element 48, two shots of ink droplets are ejected from the nozzle 23K, and thus a medium-sized dot (a medium dot) is formed on the recording sheet S. In addition, if the first pulse P1, the second pulse P2, and the third pulse P3 are output to the piezoelectric element 48, three shots of ink droplets are ejected from the nozzle 23K, and thus a large-sized dot (a large dot) is formed on the recording sheet S. As such, in the printer 20, by adjusting the amount of ink to be ejected in one pixel section, three sizes of dots can be formed. As in the nozzle 23K or the nozzle array 43K, the same process can also applied to the nozzles 23C, 23M, and 23Y or the nozzle arrays 43C, 43M, and 43Y. In the print head 24, the method of deforming the piezoelectric element 48 and pressurizing ink has been used, however, ink may be heated by applying a voltage to a heat resistive element (for example, a heater) and pressurized by generated air bubbles.

The nozzle inspection device 50 includes, as shown in FIG. 3, an inspection box 51 in which the ink droplets from the nozzles 23 of the print head 24 land, an ink receiving area 52 that is provided in the inspection box 51, a voltage application circuit 53 that applies a voltage between the ink receiving area 52 and the print head 24, and a voltage detection circuit 54 that detects a voltage generated in the ink receiving area 52. The inspection box 51 is a casing that is provided outside of the printable area on the left side of the platen 44. The inspection box 51 is a substantially rectangular parallelepiped shape and has an opened upper portion. The ink receiving area 52 is provided in the inspection box 51, and has an upper ink absorber 55 onto which the ink droplets directly land, a lower ink absorber 56 that absorbs the ink droplets penetrating downward after landing on the upper ink absorber 55, and a mesh-like electrode member 57 that is disposed between the upper ink absorber 55 and the lower ink absorber 56. The upper ink absorber 55 is made of a conductive sponge so as to have the same potential as the electrode member 57. The sponge has high permeability such that landing ink droplets can promptly move downward. Herein, an urethane sponge of ester series (Product Name: Ever Light SK-E, manufactured by Bridgestone Corporation) is used. The surface of the upper ink absorber 55 serves as the ink receiving area 52 corresponds to. The lower ink absorber 56 is made of a non-woven fabric, such as felt, which has a higher degree of retention of ink than the upper ink absorber 55. Herein, a non-woven fabric (Product Name: Kinocloth, manufactured by Oji Kinocloth Co., Ltd.) is used. The electrode member 57 is formed as a grid-like mesh made of stainless metal (for example, SUS). For this reason, ink that has once been absorbed by the upper ink absorber 55 passes through the gaps of the grid-like electrode member 57 and is then absorbed and retained by the lower ink absorber 56. The ink receiving area 52 is designed to have a greater length in the transport direction than the nozzle array 43. The upper ink absorber 55 and the lower ink absorber 56 may not be provided.

The voltage application circuit 53 electrically connects the electrode member 57 and the print head 24 through a direct-current power source (for example, 400 V) and a resistive element (for example, 1 MΩ) such that the former will be a positive electrode and the latter a negative electrode. As the electrode member 57 is in contact with the conductive upper ink absorber 55, the surface of the upper ink absorber 55, that is, the ink receiving area 52 also has the same potential as the electrode member 57. The voltage application circuit 53 has a switch SW for making and breaking a circuit. The switch SW is turned on when a head inspection routine, which will be described below, is performed. Otherwise, the switch SW is turned off. The voltage detection circuit 54 is connected so as to detect the voltage of the electrode member 57, which is considered the same as that of the ink receiving area 52. The voltage detection circuit 54 includes an integration circuit 54*a* that integrates and outputs a voltage signal of the electrode member 57, an inverting amplification circuit 54*b* that inverts, amplifies, and outputs the signal from the integration circuit 54*a*, and an A/D conversion circuit 54*c* that A/D converts the signal from the inverting amplification circuit 54*b* and outputs it to the controller. Since a change in voltage resulting from jetting and landing of one ink droplet is small, the integration circuit 54*a* outputs a large change in voltage by integrating changes in voltage caused by jetting and landing of a plurality of ink droplets ejected from the same nozzle 23. The inverting amplification circuit 54*b* inverts the positive and negative of the change in voltage, and amplifies and outputs the signals from the integration circuit at a predetermined amplification rate. The A/D conversion circuit 54*c* converts an analog signal from the inverting amplification circuit 54*b* into a digital signal and outputs the digital signal to the controller 70.

As shown in FIG. 1, the capping device 40 is used to seal off the nozzles 23 so as to prevent the nozzles 23 from being dried when printing is halted. The capping device 40 is operated to cover a nozzle forming surface of the print head 24 when the print head 24 moves with the carriage 22 to the right end (referred to as home position). In addition, a suction pump (not shown) is connected to the capping device 40. As occasion demands, for example, when ink clogging in a nozzle is detected by the nozzle inspection device 50, the suction pump causes negative pressure to act on the nozzle forming surface of the print head 24 sealed by the capping device 40, and thus ink that has clogged is sucked and discharged from the nozzles 23. Waste ink that is sucked and discharged is accumulated in a waste liquid tank (not shown). The components, such as the capping device 40, the carriage 22, the platen 44, and the like, are grounded through the mechanical frame 16 (see FIG. 1).

The buttons 85 includes an automatic nozzle inspection mode setting switch 80, a check pattern automatic print switch 81, a check pattern position setting switch 82, and a check pattern print button 83. The automatic nozzle inspection mode setting switch 80 is a user operable slide switch. The automatic nozzle inspection mode setting switch 80 is exclusively switched between a position where an automatic nozzle inspection mode is set, in which the nozzle inspection device 50 is configured to perform inspection of the nozzles 23 regularly (for example, every 15 minutes) and a position where the automatic nozzle inspection mode is not set. The check pattern automatic print switch 81 is a user operable slide switch. The check pattern automatic print switch 81 is exclusively switched between a position where a check pattern automatic print mode is set, in which a check pattern 90 is automatically printed when printing is performed on the basis of user print data, and a position where the check pattern automatic print mode is not set. The check pattern position setting switch 82 is a user operable slide switch. The check pattern position setting switch 82 is exclusively switched between a position where, when the check pattern 90 is automatically printed while printing is performed on the basis of user print data as desired data to be printed, the check pattern 90 is printed before the user print data, and a position where the check pattern 90 is printed after the user print data. The check pattern print button 83 is a push button that, when being pushed by the user, inputs a check pattern print instruction, which instructs the printer mechanism 21 to print the check pattern 90.

As shown in FIG. 1, the controller 70 is constructed as a microprocessor centered on a CPU 72, and includes a flash ROM 73 that stores various types of processing programs, a RAM 74 that temporarily stores or saves data, an interface (I/F) 79 that exchanges information with an external apparatus, and an input/output port (not shown). The flash ROM 73 also stores various process programs, such as an automatic nozzle inspection routine, a nozzle inspection routine, and a print process routine, all of which will be described below. The RAM 74 has a print buffer area. The print buffer stores print data that is transmitted from a user PC 10 through the interface (I/F) 79. To the controller 70, a voltage signal from the voltage detection circuit 54 of the nozzle inspection device 50, a position signal from the linear-type encoder 25, an operation signal from the check pattern print button 83, and the like are input through an input port. The controller 70 outputs control signals to the nozzle inspection device 50, a drive signal to the print head 24, a drive signal to the drive motor 33, a drive signal to the carriage motor 34, a signal to the capping device 40, and the like through an output port. The flash ROM 73 also stores a check pattern print program for printing a check pattern on the recording sheet S. The check pattern enables the user to visually confirm nozzle clogging or the like. The check pattern print program controls the printer mechanism 21 such that, while the carriage 22 moves in the main scanning direction, ink is initially ejected at a predetermined width from a plurality of nozzles 23 at regular intervals, ink is then ejected at the same width from a plurality of nozzles 23 with a shift by one position, and ink is subsequently ejected from a plurality of nozzles 23 with a shift by another one position. These operations are repeatedly executed such that ink is ejected from all the nozzles at a predetermined width. When the check pattern print program is executed to drive the print head 24 while moving the carriage 22 in the main scanning direction, if no abnormality, such as nozzle clogging, is produced in the nozzle 23, for example, a check pattern 90*a* shown in FIG. 4A is printed. As shown in FIG. 4A, the check pattern 90*a* is printed by all the nozzles. Meanwhile, when abnormality, such as nozzle clogging, is produced in the nozzle 23, for example, a check pattern 90*b* shown in FIG. 4B is printed. As shown in FIG. 4B, in the check pattern 90*b*, a portion corresponding to a nozzle, in which abnormality, such as nozzle clogging, is produced, is not printed. In this case, the portion corresponding to the nozzle 23, in which abnormality is produced, is not printed at a predetermined width. Therefore, the user can visually easily confirm the portion. In the following description, the check pattern 90*a* when all the nozzles are normal and the check pattern 90*b* when there is an abnormal nozzle are collectively referred to as check pattern 90.

Figure 5:
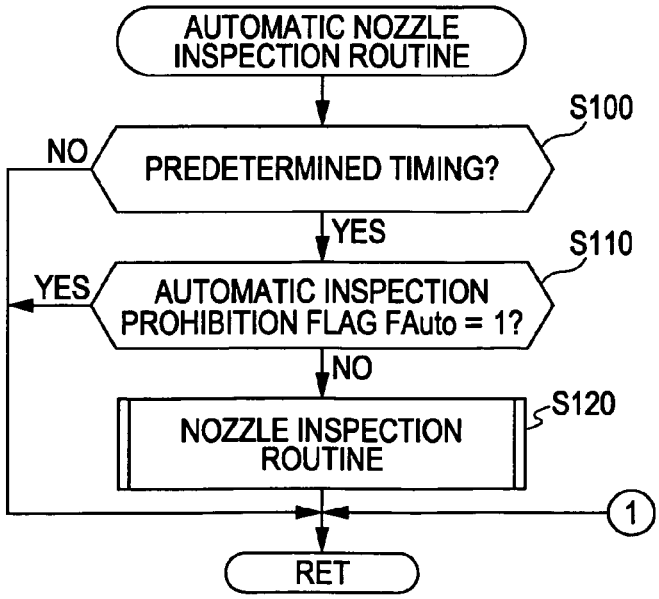
FIG. 5 is a flowchart showing an example of an automatic nozzle inspection routine.

Next, the operation of the printer 20 of this embodiment that has thus been configured will be described. FIG. 5 is a flowchart showing an example an automatic nozzle inspection routine that is executed by the CPU 72 of the controller 70. This routine is stored in the flash ROM 73 and executed by the CPU 72 at predetermined timings (for example, every several msecs) after the printer 20 is turned on in a state in which the automatic nozzle inspection mode is set. If this routine is started, the CPU 72 first determines whether or not it is a predetermined automatic inspection timing (Step S100). Herein, it is assumed that the automatic inspection timing comes every 15 minutes after the printer 20 is turned on, but the automatic inspection timing is not limited to every 15 minutes. For example, the automatic inspection timing may be, after the printer 20 is turned on, each time single user print data is processed, 15 pages are processed, one page is processed, 30 minutes elapses, or one minute elapses. Specifically, the automatic inspection timing may be each time an empirically determined number of user print data in which ink may not be ejected from the nozzles 23 are processed, each time an empirically determined number of pages in which ink may not be ejected from the nozzles 23 are processed, each time an empirically determined time at which ink may not be ejected from the nozzles 23 elapses, or each time an empirically determined number of print passes in which ink may not be ejected from the nozzles 23 pass. When it is not the automatic inspection timing, this routine is ended. Meanwhile, when it is the automatic inspection timing, it is determined whether or not an automatic inspection prohibition flag FAuto is "1" (Step S110). The automatic inspection prohibition flag FAuto used herein is a flag indicative of whether or not inspection or cleaning of the nozzle 23 is prohibited in this routine. The automatic inspection prohibition flag FAuto is set to "1" or is reset to "0" in a print process routine, which will be described below. When the flag FAuto is "1", it indicates that nozzle inspection or cleaning is prohibited in this routine. When the flag FAuto is "0", it indicates that nozzle inspection or cleaning is not prohibited. The initial value of the automatic inspection prohibition flag FAuto is "0". When the flag FAuto is "1", since nozzle inspection or cleaning is prohibited, this routine is ended. Meanwhile, when the flag FAuto is "0", since nozzle inspection or cleaning is not prohibited, a nozzle inspection routine, which will be described below, is executed (Step S120), and then this routine is ended. As such, when the automatic inspection timing comes, if the flag FAuto is "1", the nozzle inspection routine is executed, and if the flag FAuto is "0", the nozzle inspection routine is not executed.

Figure 6:
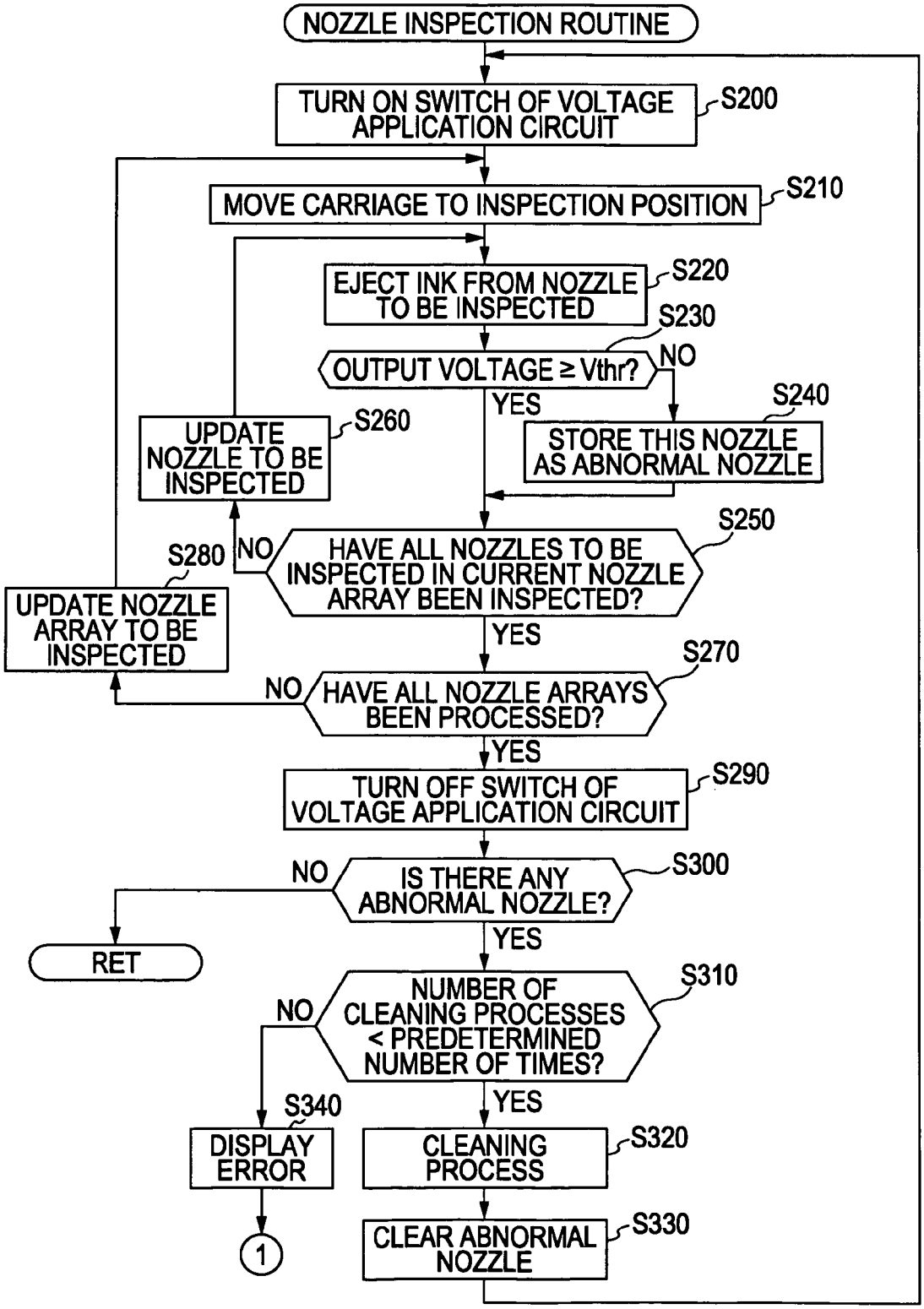
FIG. 6 is a flowchart showing an example of a nozzle inspection routine.

The nozzle inspection routine will now be described. As shown in FIG. 6, this routine is a process including a nozzle inspection process that inspects whether or not clogging occurs in any of the nozzles 23 arranged in the print head 24, that is, whether or not ink can be ejected from the nozzles 23, and is stored in the flash ROM 73. If this routine is started, the CPU 72 turns on the switch SW of the voltage application circuit 53 (Step S200). Next, the CPU 72 drives the carriage motor 34 to move the carriage 22 in such a way that, among the nozzle arrays 43 of the print head 24, a nozzle array 43 to be inspected is opposed to a predetermined inspection position (Step S210). From one nozzle 23 in the nozzle array 43 to be inspected, charge ink droplets are ejected through the mask circuit 47*s* and the piezoelectric element 48*s* (see FIG. 2) corresponding to the nozzle 23 (Step S220). The nozzles 23 in the nozzle array 43 are set in such a manner that ink droplets are ejected from the nozzles 23 in an ascending order of the nozzle number n when the inspection is started. Accordingly, the voltage of the ink receiving area 52 is changed until negatively charged ink droplets are jet from one nozzle 23 and land on the ink receiving area 52, and the voltage detection circuit 54 detects the change in voltage. When this experiment is actually conducted, the voltage detected by the voltage detection circuit 54 is represented as a sine curve. Although the principle whereby the sine curve is obtained is unknown, but it can be attributed to the fact that as the charged ink droplets approach the ink receiving area 52, an induced current flows due to electrostatic induction. Next, the CPU 72 determines whether or not the amplitude of a signal waveform detected by the voltage detection circuit 54, that is, the output level, is equal to or larger than a threshold value Vthr (Step S230). The threshold value Vthr is an empirically determined value that is exceeded by the output level (peak value) of the output signal waveform when 24 shots of ink droplets are ejected normally, or is not exceeded due to noise when the 24 shots of ink droplets are not ejected normally. The 24 shots of ink droplets are ejected by performing 8 times an operation to output all of the first to third pulses P1, P2, and P3 of one segment representative of a drive waveform. In this manner, the output level becomes an integrated value for 24 shots of ink droplets, and a sufficiently large output waveform is obtained from the voltage detection circuit 54. The amplitude of a signal output from the voltage detection circuit 54 is inverted because it passes through the inverting amplification circuit 54*b*.

If in Step S230 the output level is smaller than the threshold value Vthr, taking into consideration that abnormality, such as clogging, occurs at the present nozzle 23, the CPU 72 stores in the RAM 74 information specifying the nozzle 23 (for example, information specifying what nozzle array is involved and what nozzle in the nozzle array is involved) (Step S240). If after Step S240 or in Step S230 the output level is equal to or larger than the threshold value Vthr (that is, the nozzle 23 is normal), it is determined whether or not all of the nozzles 23 included in the nozzle array 43 being currently inspected have been inspected (Step S250). If any nozzle 23 in the nozzle array being currently inspected remains uninspected, the CPU 72 updates the nozzles 23 to be inspected with the uninspected nozzle (Step S260), and then Steps S210 to S260 are executed again. Meanwhile, if in Step S250 all the nozzles 23 in the nozzle array being currently inspected have been inspected, it is determined whether or not all the nozzle arrays 43 included in the print head 24 have been inspected (Step S270). If any nozzle array 43 remains uninspected, the CPU 72 updates the nozzle array 43 to be inspected with the uninspected nozzle array 43 (Step S280), and Steps S210 to S280 are executed again. That is, in Steps S210 to S280, after the print head 24 is moved to a predetermined inspection position, ink is ejected from the all the nozzles 23 in the nozzle array 43, and then on the basis of the voltage detected by the voltage detection circuit 54, it is determined whether or not ink is ejected from the nozzles 23.

If in Step S270 all the nozzle arrays 43 included in the print head 24 have been inspected, the CPU 72 turns off the switch SW of the voltage application circuit 53 (Step S290), and determines on the basis of the contents stored in the RAM 74 whether or not any nozzle is abnormal (Step S300). If any abnormal nozzle 23 exists, the CPU 72 determines that clogging has caused abnormality, and cleans the print head 24. However, before doing so, the CPU 72 determines whether or not the number of cleaning processes previously conducted is less than a predetermined number (for example, three times) (Step S310). If the number of cleaning processes previously conducted is less than the predetermined number, the CPU 72 performs the cleaning process of the print head 24 (Step S320). Specifically, the CPU 72 drives the carriage motor 34 to move the carriage 22 to the home position where the print head 24 is opposed to the capping device 40, and operates the capping device 40 such that the capping device 40 covers the nozzle forming surface of the print head 24. Then, negative pressure of the suction pump (not shown) acts on the nozzle forming surface, and thus ink that has clogged is sucked and discharged from the nozzles 23. After the cleaning process is finished, information about an abnormal nozzle stored in the RAM 74 is cleared (Step S330), the process returns to Step S200 in order to check whether or not abnormality in the nozzle 23 has been eliminated. In Step S200 and later, although only the abnormal nozzle 23 may be reexamined, all the nozzles 23 in the print head 24 need to be reexamined since the nozzles 23 that were normal at the time of cleaning may have clogged for some reason. Meanwhile, if in Step S310 the number of cleaning processes is equal to or more than the predetermined number, the CPU 72 determines that the abnormal nozzle 23 is not normal even after cleaning, and displays an error message on an operation panel (not shown) (Step S340). Thus, the process returns to the automatic nozzle inspection routine shown in FIG. 5, and the automatic nozzle inspection routine is ended. Meanwhile, if in Step S300 no abnormal nozzle 23 exists, that is, when ink can be ejected from all the nozzles 23 in the print head 24, the nozzle inspection routine is ended. As such, it is checked whether or not clogging occurs in all the nozzles 23 in the print head 24, and when clogging occurs, cleaning is performed less than a predetermined number of times. Thus, nozzle clogging is eliminated.

Figure 7:
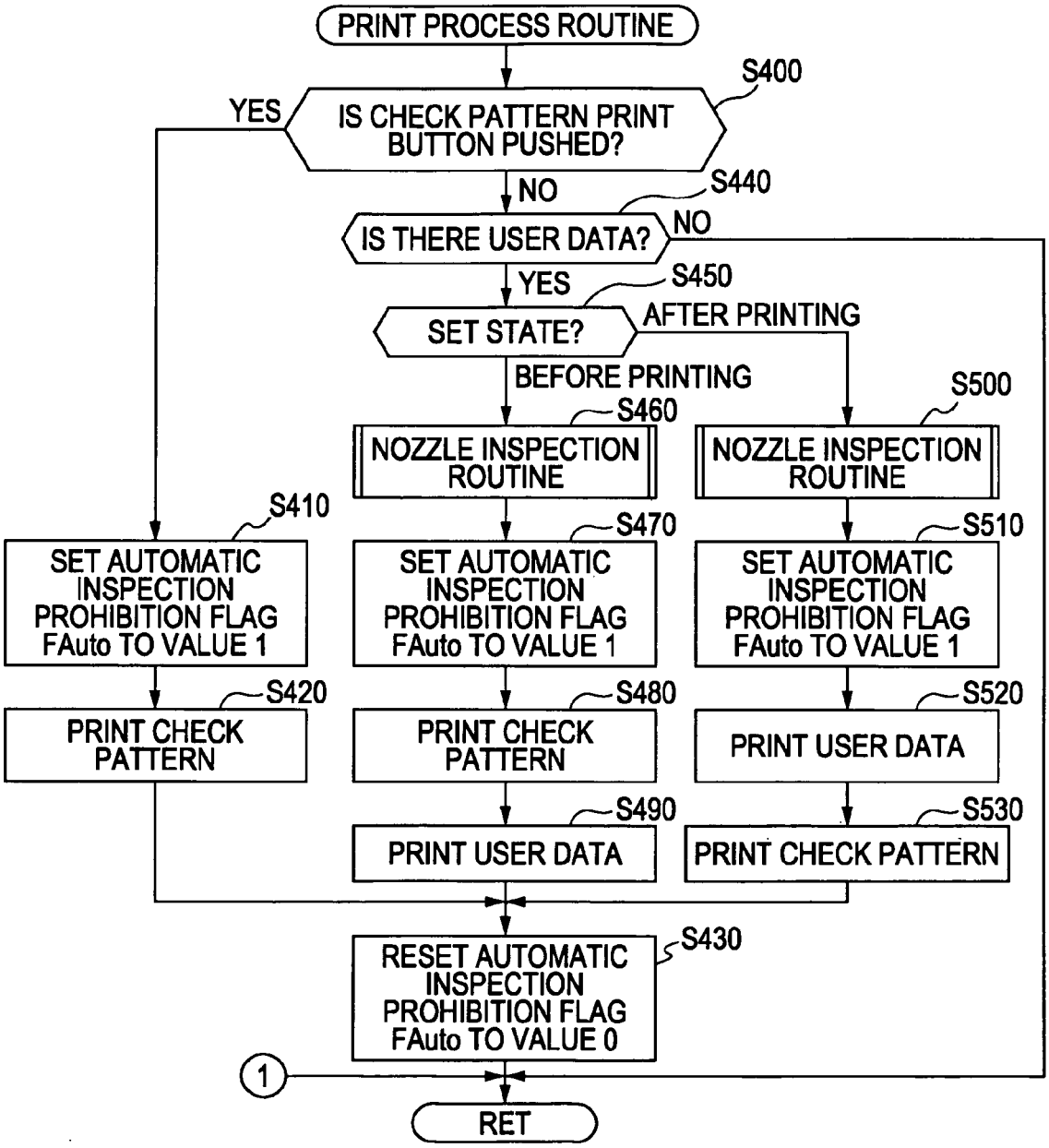
FIG. 7 is a flowchart showing an example of a print process routine.

Next, a print process routine that is executed in parallel with the automatic nozzle inspection routine shown in FIG. 5 will be described. FIG. 7 is a flowchart showing an example of a print process routine that is executed by the CPU 72 of the controller 70. This routine is stored in the flash ROM 73, and after the printer 20 is turned on, is executed repeatedly by the CPU 72 in a state in which the automatic nozzle inspection mode is set and the check pattern automatic print mode is set. If this routine is started, the CPU 72 first determines whether or not the check pattern print button 83 is pushed (Step S400). If the check pattern print button 83 is pushed, the automatic inspection prohibition flag FAuto is set to "1" (Step S410). That is, even if a predetermined timing comes in the automatic nozzle inspection routine shown in FIG. 5, which is executed in parallel, the nozzle inspection routine shown in FIG. 6 is not executed. Then, the CPU 72 reads the check pattern print program for printing the check pattern 90 from the flash ROM 73 and controls the printer mechanism 21 according to the program such that the check pattern 90 is printed on the recording sheet S (Step S420). The print process alternately repeats a process for performing printing on the basis of print data (the check pattern print program) by driving the carriage motor 34 to move the carriage 22 in the main scanning direction and ejecting ink from the print head 24, and a transport process for rotating the sheet feed roller 35 to transport the recording sheet S by a predetermined amount. Next, the automatic inspection prohibition flag FAuto is reset to "0" (Step S430), and this routine is ended. That is, after the check pattern 90 that enables confirmation of the states of the nozzles 23 is printed, since it is acceptable to perform automatic nozzle inspection, the automatic inspection prohibition flag FAuto is reset to "0". In this way, the user can view the printed check pattern 90 to confirm the states of the nozzles 23.

If in Step S400 the check pattern print button 83 is not pushed, the CPU 72 determines whether or not user print data that needs to be printed exists (Step S440). It is assumed that the user print data that needs to be printed is stored in the print buffer (not shown) of the RAM 74, and when user print data is stored in the print buffer, it is determined that the user print data that needs to be printed exists. If no user print data that needs to be printed exists, this routine is ended. Meanwhile, when a print job is input from the user PC 10 and user print data is stored in the RAM 74, it is determined that user print data that needs to be printed exists. In this case, it is desirable to confirm the set state of a position where the check pattern is to be printed (Step S450). Here, the set state of the position where the check pattern is to be printed is confirmed in such a manner that the switched state of the check pattern position setting switch 82 is confirmed by means of a sensor (not shown). When the set state is a state in which the check pattern is to be printed before the user print data is printed, the nozzle inspection routine is executed (Step S460) to make all the nozzles 23 possible to eject ink, and sets the automatic inspection prohibition flag FAuto to "1" (Step S470). That is, until the flag FAuto is reset to "0", even if a predetermined timing comes in the automatic nozzle inspection routine shown in FIG. 5, the nozzle inspection routine shown in FIG. 6 is not executed. Next, the CPU 72 controls the printer mechanism 21 to print the check pattern 90 (Step S480), and subsequently controls the printer mechanism 21 to perform printing on the basis of the user print data (Step S490). After printing is ended, in Step S430, the automatic inspection prohibition flag FAuto is rest to "0", and this routine is ended. As such, when the set state of the position where the check pattern is to be printed is a state in which the check pattern is to be printed before the user print data is printed, the check pattern is printed after inspection of the nozzles 23 and if necessary, nozzle cleaning are executed, and thereafter printing based on the user print data is performed. Therefore, it is possible to print a check pattern that enables the user to confirm that an image at the beginning of printing based on user print data is an image with no nozzle that does no eject ink.

When Step S450 the set state of the position where the check pattern is to be printed is a state in which the check pattern is to be printed after printing, the CPU 72 executes the nozzle inspection routine (Step S500) to make all the nozzles 23 possible to eject ink, and sets the automatic inspection prohibition flag FAuto to "1" (Step S510). Next, the CPU 72 controls the printer mechanism 21 to perform printing on the basis of the user print data (Step S520), and subsequently controls the printer mechanism to print the check pattern 90 (Step S530). After printing is ended, in Step S430, the automatic inspection prohibition flag FAuto is reset to "0", and this routine is ended. As such, when the set state of the position where the check pattern 90 is to be printed is a state in which the check pattern is to be printed after printing, after printing is performed on the basis of the user print data, the check pattern 90 is printed without performing nozzle inspection or nozzle cleaning. Therefore, a check pattern having reflected therein the nozzle states when printing based on the user print data is completed is printed. In the nozzle inspection routine of Step S460 or S500, when the number of cleaning processes has reached the predetermined number, an error is displayed (after Step S340 in FIG. 6). Thus, the process returns to the print process routine, and the print process routine is ended.

Figure 8A:
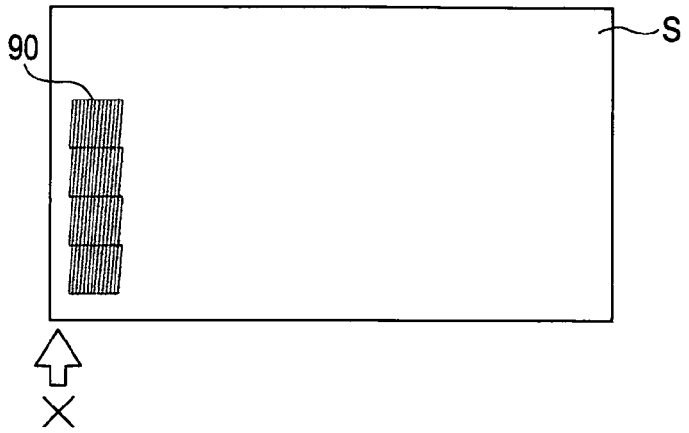
FIGS. 8A to 8C are explanatory views of the print positional relationship on a recording sheet S and a nozzle inspection timing.
Figure 8B:
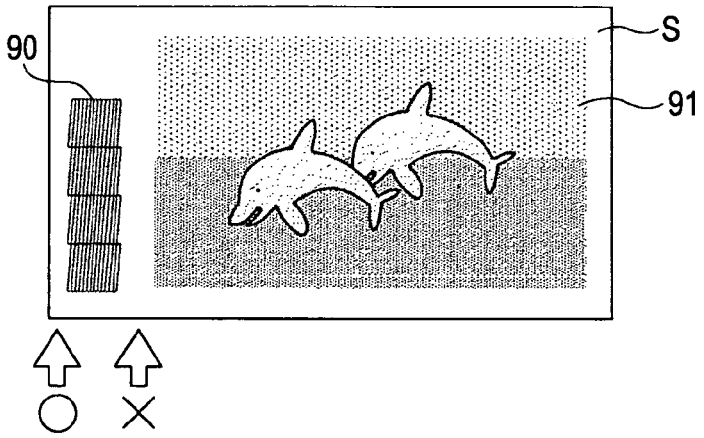
Figure 8C:
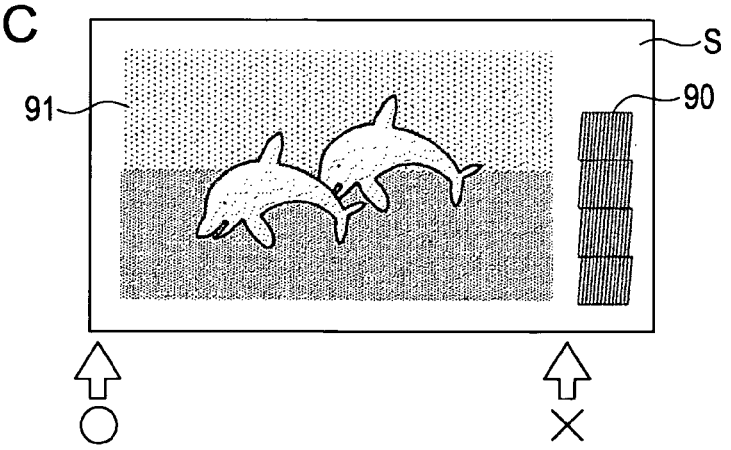
Figure 8C:
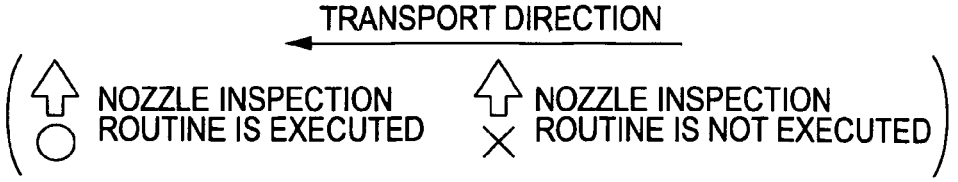

The printed state of the recording sheet S when the print process routine is executed will now be described. FIGS. 8A to 8C are explanatory views of the print positional relationship on the basis of the check pattern 90 or user print data 91 printed on a recording sheet S when the print process routine shown in FIG. 7, and an execution timing of the nozzle inspection routine. When the check pattern print button 83 is pushed, the CPU 72 executes printing of the check pattern 90, without executing the nozzle inspection routine, in a state in which the nozzle inspection routine is prohibited in the automatic nozzle inspection routine, as shown in FIG. 8A. In a state in which the check pattern automatic print mode is set, when the set state is the state in which the check pattern is to be printed before printing based on the user print data, as shown in FIG. 8B, the check pattern 90 is printed before printing on the basis of the user print data 91. In this case, the nozzle inspection routine is executed before the check pattern 90 is printed. Meanwhile, the nozzle inspection routine is not executed between printing of the check pattern 90 and printing based on the user print data 91. In addition, in a state in which the check pattern automatic print mode is set, when the set state is the state in which the check pattern is to be printed after printing based on the user print data, as shown in FIG. 8C, the check pattern 90 is printed after printing based on the user print data 91. In this case, the nozzle inspection routine is executed before printing based on the user print data 91. Meanwhile the nozzle inspection routine is not executed between printing based on the user print data 91 and printing of the check pattern 90. As such, when the user pushes the check pattern print button 83 so as to have information about the states of the nozzles 23, as shown in FIG. 8A, the nozzle inspection routine is not executed, and the check pattern 90 having reflected therein the nozzle states at that time is printed. Therefore, when the user views the check pattern 90 and confirms that there is a portion where the check pattern 90 is not printed, he/she pushes a cleaning button (not shown). If so, the printer 20 executes cleaning of the nozzles 23 in the print head 24. When the user wants to confirm that an image at the beginning of printing based on the user print data is an image with no nozzle not ejecting ink, he/she operates the check pattern automatic print switch 81 to set the check pattern automatic print mode and simultaneously operates the check pattern position setting switch 82 to set the state in which the check pattern is to be printed before printing based on the user print data. If so, when performing printing based on the user print data, as shown in FIG. 8B, the printer 20 executes the nozzle inspection routine, and thereafter the check pattern 90 is printed and printing based on the user print data 91 is performed. Therefore, the user can view the printed check pattern 90 to confirm the nozzle states at the beginning of printing based on the user print data. Furthermore, in a state in which no nozzle not ejecting ink exists, when the user wants to confirm the nozzle states when printing based on the user print data 91 is finished after printing based on the user print data 91 is started, he/she operates the check pattern automatic print switch 81 to set the check pattern automatic print mode, and simultaneously operates the check pattern position setting switch 82 to set the state in which the check pattern is to be printed after printing based on the user print data. If so, when performing printing based on the user print data 91, as shown in FIG. 8C, the printer 20 executes the nozzle inspection routine, and thereafter printing based on the user print data 91 is performed and the check pattern 90 is printed. Therefore, the user can view the printed check pattern 90 to confirm the nozzle states when printing based on the user print data is finished. As such, when the check pattern 90 is printed before printing based on the user print data, the check pattern 90 having reflected therein the nozzle states at the beginning of printing is printed. As a result, it is possible to ensure that printing based on the user print data is performed with normal quality. Furthermore, when the check pattern 90 is printed after printing based on the user print data, the check pattern 90 having reflected therein the nozzle states when printing is finished is printed. As a result, it is possible to ensure that printing based on the user print data is performed with normal quality. This is because a nozzle 23 not ejecting ink rarely occurs during printing based on the user print data or printing of the check pattern. As such, nozzle inspection is not executed between printing based on the user print data and printing of the check pattern 90, and thus useless inspection can be suppressed.

Next, the relationship between the components of this embodiment and those of the invention will be clarified. The printer 20 of this embodiment corresponds to a printing apparatus of the invention. The print head 24 corresponds to an ejection unit. The nozzle inspection device 50 corresponds to a nozzle inspection unit. The capping device 40, the suction pump (not shown), and the controller 70 correspond to a cleaning unit. The check pattern print button 83 corresponds to an instruction input unit. The check pattern automatic print switch 81 corresponds to an automatic print setting unit. The automatic nozzle inspection mode setting switch 80 corresponds to an automatic inspection setting unit. The controller 70 corresponds to a control unit. The recording sheet S corresponds to a target. The ink receiving area 52 corresponds to a liquid receiving area. The voltage application circuit 53 corresponds to a voltage application unit. The voltage detection circuit 54 corresponds to an electrical change detection unit.

According to the printer 20 of this embodiment, even if the automatic nozzle inspection mode is set, when the user inputs the check pattern print instruction, the check pattern 90 is printed, without performing nozzle inspection and nozzle cleaning. Therefore, the check pattern 90 having reflected therein the state of the nozzle 23 at that time is printed. In addition, when the check pattern automatic print mode is set, the check pattern 90 is printed, without performing nozzle inspection and nozzle cleaning, during a period from when one of printing based on the user print data 91 and printing of the check pattern 90 is started until the other is finished. Therefore, the check pattern 90 with the nozzle state reflected is printed at the beginning or end of printing based on the user print data 91. As a result, it is possible to print the check pattern 90, from which information according to the user's intention is obtained.

When the automatic nozzle inspection mode is set, and when the check pattern automatic print mode is set while printing based on the user print data 91 is being performed, if the check pattern 90 is printed before printing based on the user print data 91, nozzle inspection is executed before the check pattern 90 is printed. At this time, when any nozzle 23 not ejecting ink exists, nozzle cleaning is executed. In a state in which no nozzle 23 not ejecting ink exists, the check pattern 90 is printed and then printing based on the user print data 91 is performed. Therefore, it is possible to print the check pattern 90 for confirming and ensuring that an image at the beginning of printing based on the user print data 91 is an image with no nozzle 23 not ejecting ink. In addition, when the automatic nozzle inspection mode is set, and when the check pattern automatic print mode is set while printing based on the user print data is being performed, if the check pattern 90 is printed after printing based on the user print data 91 is performed, nozzle inspection is executed before printing based on the user print data 91. At this time, when any nozzle 23 not ejecting ink exists, nozzle cleaning is executed. In a state in which no nozzle 23 not ejecting ink exists, printing based on the user print data 91 is started. Thus, it is possible to ensure that an image at the beginning of printing based on the user print data 91 is an image with no nozzle 23 not ejecting ink. Furthermore, the nozzle inspection device 50 includes the ink receiving area 52, the voltage application circuit 53, and the voltage detection circuit 54. With this configuration, for nozzle inspection is executed, in a state in which the voltage application circuit 53 applies a predetermined voltage between the print head 24 and the ink receiving area 52, the nozzles 23 sequentially eject ink onto the ink receiving area 52. And, on the basis of a change in voltage detected by the voltage detection circuit 54, the nozzle inspection device 50 executes nozzle inspection as to whether or not ink is ejected from the nozzles. That is, nozzle inspection can be executed, without performing printing.

It should be noted that the invention is not limited to the foregoing embodiment, but it can be implemented in various aspects without the technical scope of the invention.

In the foregoing embodiment, when the automatic nozzle inspection mode is set, if check pattern 90 is printed before printing based on the user print data 91, the nozzle inspection routine is executed before the check pattern 90 is printed. In addition, when the check pattern 90 is printed after printing based on the user print data 91, the nozzle inspection routine is executed before printing based on the user print data. However, in one or both cases, the nozzle inspection routine may not be executed. In any case, it is possible to print the check pattern 90, from which information according to the user's intention is obtained. The reason is as follows. That is, a nozzle 23 that does not eject ink rarely occurs during printing based on the user print data or printing of the check pattern. In addition, if a predetermined automatic inspection timing comes in the automatic nozzle inspection routine shown in FIG. 5, the nozzle inspection routine shown in FIG. 6 is executed before printing based on the user print data or printing of the check pattern 90.

Figure 9A:
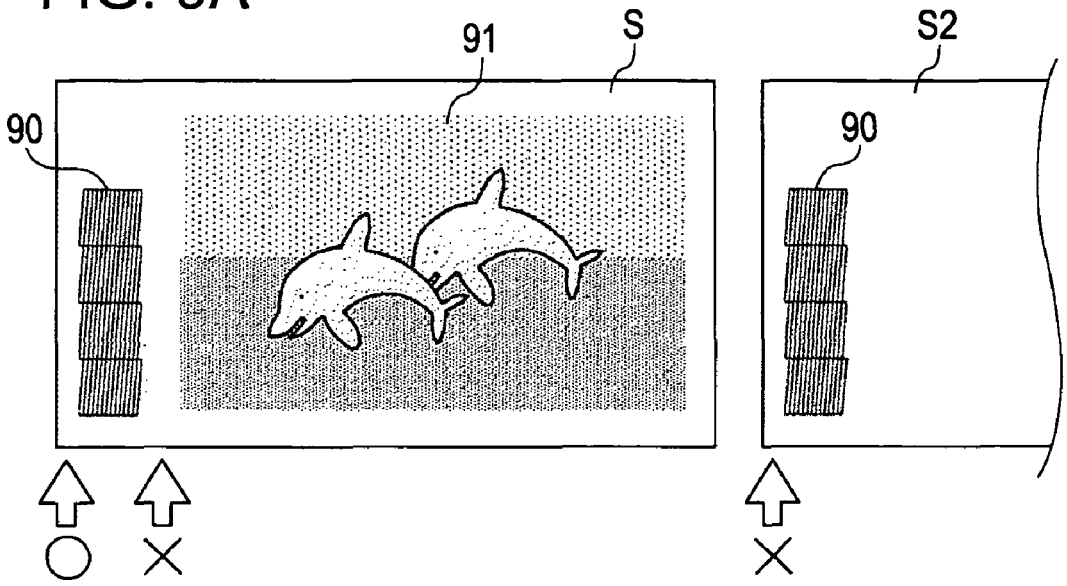
FIGS. 9A and 9B are explanatory views of the print positional relationship on a recording sheet S and a nozzle inspection timing.

In the embodiment, when the automatic nozzle inspection mode is set, and when the check pattern automatic print mode is set while printing based on the user print data 91 is being performed, if the check pattern 90 is to be printed before printing based on the user print data, as shown in FIG. 8B, the check pattern 90 is printed before printing based on the user print data 91. However, as shown in FIG. 9A, the check pattern 90 may be printed after printing based on the user print data, in addition to before printing based on the user print data 91, and even if a predetermined timing comes during a period from when printing based on the user print data 91 is finished until the check pattern 90 is printed, the nozzle inspection routine may not be executed. In this case, it is possible to print a check pattern in which the states of the nozzles 23 immediately after printing based on the user print data are reflected.

In the embodiment, in the print process routine shown in FIG. 7, in Step S470 and S510, the automatic inspection prohibition flag FAuto is set to "0", such that the nozzle inspection routine shown in FIG. 6 is not executed in the automatic nozzle inspection routine shown in FIG. 5. However, in Step S470 and S510, the automatic nozzle inspection routine shown in FIG. 6 may be halted.

Figure 9B:
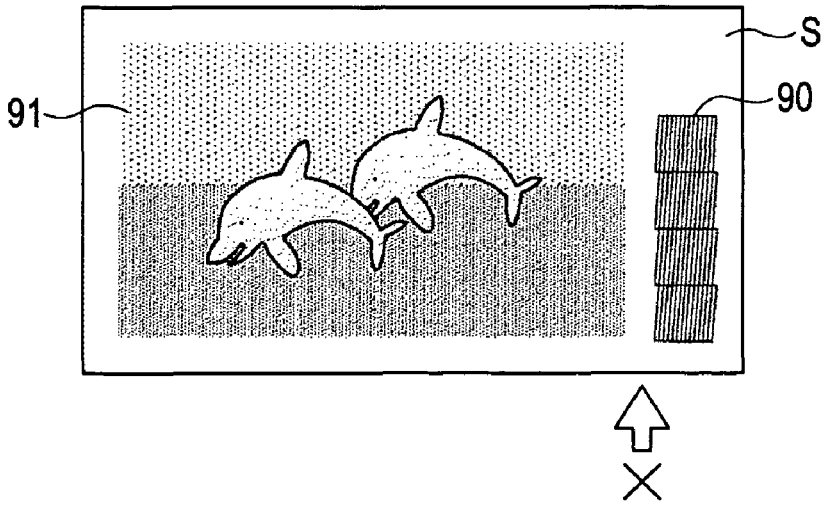

In the embodiment, when the automatic nozzle inspection mode is set, and when the check pattern 90 is printed after printing based on the user print data 91, the nozzle inspection routine is executed before printing based on the user print data 91. However, as shown in FIG. 9B, the nozzle inspection routine may not be executed before printing based on the user print data 91. In this case, it is also possible to print the check pattern 90, from which information according to the user's intention is obtained.

Figure 10:
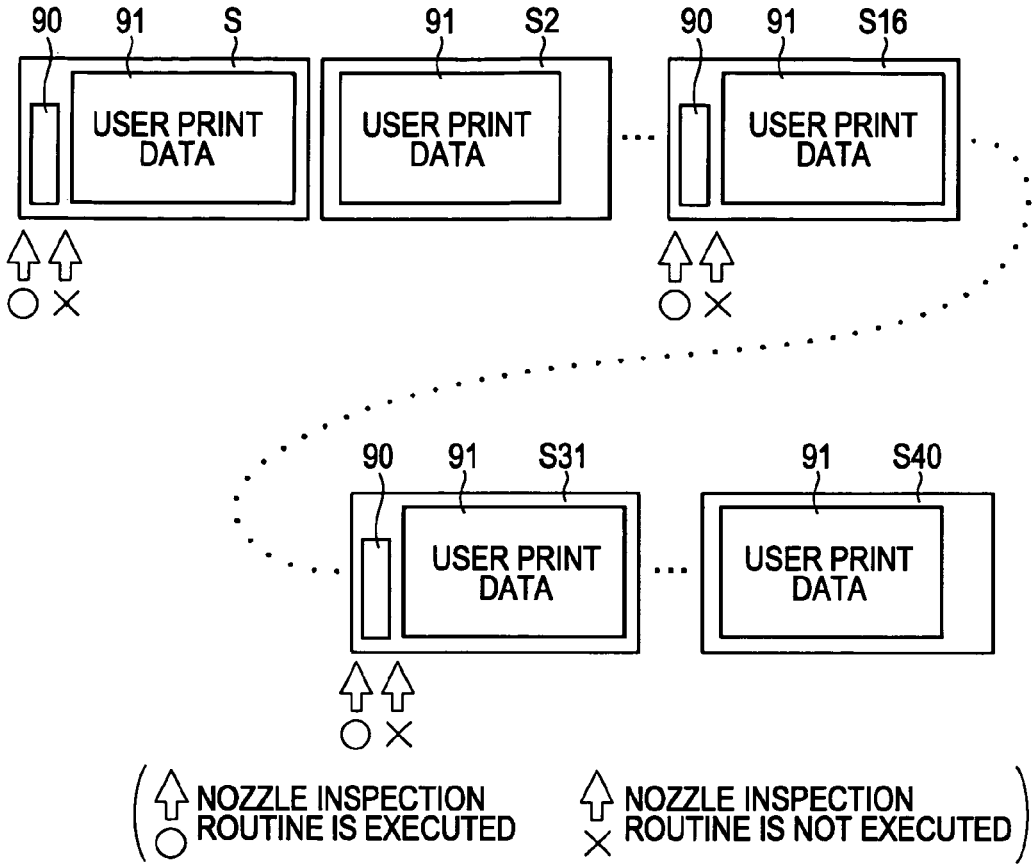
FIG. 10 is an explanatory view of the print positional relationship on a recording sheet S and a nozzle inspection timing.

In the embodiment, in a state in which the automatic inspection prohibition flag FAuto is "1", nozzle inspection is not executed while printing based on the user print data 91 is being performed. However, when a predetermined midstream inspection condition is established, printing based on the user print data 91 may be paused and nozzle inspection may be executed. For example, when a predetermined midstream inspection condition is established, if the set state is the state that the check pattern is to be printed before printing based on the user print data, printing may be paused at a point of time at which a page being printed is printed, and nozzle inspection may be executed. At this time, when a nozzle not ejecting ink exists, after nozzle cleaning is executed, the check pattern may be printed and printing may be resumed. The term "predetermined midstream inspection condition is established" may be, for example, each time an empirically determined number of pages in which ink may not be ejected from the nozzles 23 are printed, each time an empirically determined time at which ink may not be ejected from the nozzles 23 elapses, or each time an empirically determined number of passes in which ink may not be ejected from the nozzles 23 pass. Specifically, as shown in FIG. 10, when user print data consisting of 40 pages is printed, if midstream inspection is set to be executed every 15 pages, the check pattern 90 is printed on a recording sheet S, on which a first page is printed, before user print data, and nozzle inspection is executed before then. After 15 pages in the user print data are printed, the check pattern 90 is printed on a recording sheet S16, on which a 16-th page is to be printed, before user print data, and nozzle inspection is executed before then. After another 15 pages of the user print data are printed, the check pattern 90 is printed on a recording sheet S31, on which a 31-the page is printed, before user print data 91, and nozzle inspection is executed before then. Alternatively, when the set state is a state in which a check pattern is printed after printing based on user print data, after a page being printed is printed, the check pattern is printed. Then, at the point of time at which the check pattern is printed, printing is paused, and nozzle inspection is executed. At this time, when a nozzle not ejecting ink exists, after nozzle cleaning is executed, printing based on the user print data may be resumed, and then the check pattern may be printed. In these cases, when printing based on user print data consisting of multiple pages is performed, it is possible to reduce the number of pages to be printed in a state in which a nozzle 23 not capable of ejecting ink occurs. Furthermore, in these cases, nozzle inspection is not executed during a period from when one of printing based on the user print data and printing of the check pattern 90 is started until the other is finished.

In the embodiment, the automatic nozzle inspection routine shown in FIG. 5 and the print process routine shown in FIG. 7 are executed in parallel. In addition, in Step S460 or S500 of the print process routine shown in FIG. 7, the nozzle inspection routine shown in FIG. 6 is executed. However, without executing the automatic nozzle inspection routine shown in FIG. 5 and Steps S460, S470, S430, S500, and S510 of the print process routine shown in FIG. 7, the print process routine corresponding to Steps S100 and S120 of the automatic nozzle inspection routine shown in FIG. 5 may be executed between Step S440 and Step S450, Step S450 and Step S480, and Step S450 and Step S520. That is, during a period from when in Step S440 of the print process routine shown in FIG. 7 user print data exists until one of printing based on the user print data and printing of the check pattern 90 is performed, it may be determined whether or not a predetermined automatic inspection timing comes. When the automatic inspection timing does not come, printing based on the user print data or printing of the check pattern 90 may be performed. Meanwhile, when the automatic inspection timing comes, after the nozzle inspection routine may be executed, printing based on the user print data or printing of the check pattern 90 may be performed.

In the embodiment, in the nozzle inspection routine shown in FIG. 6, ink is ejected from the print head 24 in a state in which the negative ink receiving area 52 is positively charged, and a change in voltage at that time is detected by the voltage detection circuit 54, thereby executing nozzle inspection. Alternatively, the voltage application circuit 53 may electrically connect the electrode member 57 and the print head 24 through a DC power source and a resistive element such that the former will be a negative electrode and the latter a positive electrode. And, the voltage detection circuit 54 may be connected so as to detect the voltage of the print head 24. Then, the CPU 72 may execute a process based on the above-described nozzle inspection routine, and on the basis of a change in voltage to be detected whether or not ink is ejected from the nozzles. In this case, it is also possible to print the check pattern 90, from which information according to the user's intention is obtained.

Figure 11:
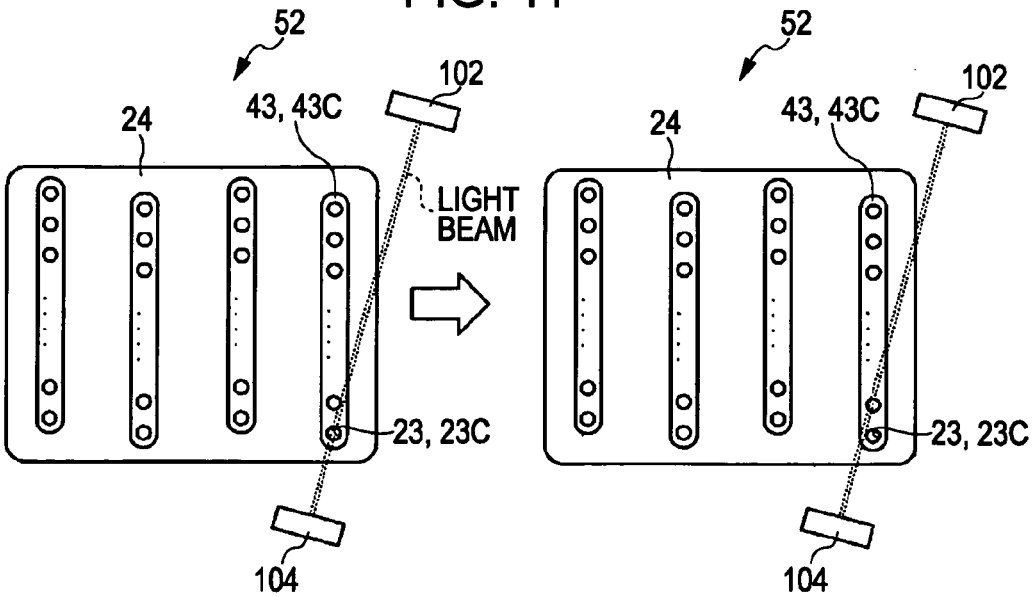
FIG. 11 is an explanatory view illustrating another nozzle inspection method.

In the embodiment, in the nozzle inspection routine shown in FIG. 6, ink is ejected from the print head 24 in a state in which the negative ink receiving area 52 is positively charged, and a change in voltage at that time is detected by the voltage detection circuit 54, thereby executing nozzle inspection. However, nozzle inspection may be executed by means of other methods. For example, the configuration shown in FIG. 11 may be used. Referring to FIG. 11, a light emitting device 102 for emitting light beams and a light receiving device 104 for receiving the light beams are disposed in the ink receiving area 52. Then, in a state in which light beams in a direction intersecting an ink ejection direction are emitted from the light emitting device 102 to the light receiving device 104 between the print head 24 and the ink receiving area 52, the print head 24 is disposed at a position where ink ejected from one nozzle 23 blocks laser light. Next, ink is ejected from the nozzle 23 onto the ink receiving area 52, and then it is determined on the basis of a change in the amount of light received by the light receiving device 104 whether or not the light beam is blocked due to ejected ink. Thus, nozzle inspection as to whether or not ink is ejected from the nozzle 23. Next, the print head 24 is disposed at a position where ink ejected from a next nozzle 23 and laser light intersect, and nozzle inspection is executed in the same manner. As such, nozzle inspection is performed by repeating the above-described operation. Alternatively, after the check pattern 90 is printed on the recording sheet S, the user can inspect visually or by means of a reading device (not shown) whether or not ink is ejected from the nozzles. In these cases, it is also possible to print the check pattern 90, from which information according to the user's intention is obtained.

Although in the embodiment a case in which the automatic nozzle inspection mode is set has been described, when the automatic nozzle inspection mode is not set, if the user pushes a cleaning button (not shown), the CPU 72 may execute the cleaning process of the nozzles 23 and then may execute the nozzle inspection routine. If doing so, it is possible to set a state in which no nozzle not ejecting ink exists, as intended by the user.

Although in the embodiment the printer 20 has been described in which printing is performed while the print head 24 reciprocates in the main scanning direction, a printer including a line head, in which nozzles arranged at the width of the recording sheet S or more in the main scanning direction may be used.

In the foregoing embodiment, a printing apparatus is implemented to the printer 20, but it may be implemented to a printing apparatus ejecting a liquid other than ink, a liquid material (dispersion liquid), in which particles of a function material are dispersed, or a fluid, such as gel, or a printing apparatus ejecting a solid material, which can be ejected as a fluid. For example, it may be a liquid ejecting apparatus ejecting a liquid, in which an electrode material or a color material is dissolved, and which is used in manufacturing a liquid crystal display, an EL (Electro Luminescence) display, a surface emission display, or color filters, a liquid material ejecting apparatus ejecting a liquid material, in which an electrode material or a color material is dispersed, or a liquid ejecting apparatus ejecting a liquid which is a sample as a precision pipette. In addition, it may be a liquid ejecting apparatus ejecting on a substrate a transparent resin liquid, such as UV curable resin, to form a fine hemispheric lens (optical lens) for use in an optical communication element, a fluid material ejecting apparatus ejecting gel, or a power ejection-type recording apparatus ejecting powder, such as toner.

What is claimed is:

1. A printing apparatus, comprising:

an ejection unit that ejects a fluid from nozzles onto a target;

a nozzle inspection unit that performs nozzle inspection to inspect whether or not the fluid is ejected from the nozzles;

an automatic print setting unit that, when printing based on print data to be printed is to be performed, sets a check pattern automatic print mode in which a check pattern for confirming whether or not the fluid is ejected from the nozzles is printed, together with the print data;

an automatic inspection setting unit that, when a predetermined automatic inspection condition is established, sets an automatic nozzle inspection mode in which the nozzle inspection is performed;

a cleaning unit that, when the result of the nozzle inspection indicates that there is an abnormal nozzle, performs nozzle cleaning to clean the nozzles; and a control unit that, when the automatic nozzle inspection mode is set, if the automatic inspection condition is established while printing based on the print data is being performed in the check pattern automatic print mode, controls the nozzle inspection unit so as not to perform the nozzle inspection during a period from when one of printing based on the print data and printing of the check pattern is started until the other is finished, wherein, when printing based on the print data is to be performed in a state in which the automatic nozzle inspection mode is set, and when a predetermined midstream inspection condition is established while print data consisting of multiple pages is printed, if printing of the check pattern is to be performed before printing based on the print data, the control unit controls the ejection unit so as to pause printing at a point of time at which printing of a page being printed is completed and controls the nozzle inspection unit so as to perform the nozzle inspection, and subsequently controls the ejection unit so as to print the check pattern and resume printing based on the print data, and if printing of the check pattern is to be performed after printing based on the print data, the control unit controls the ejection unit so as to print the check pattern after printing of the page being printed is completed, then controls the ejection unit so as to pause printing at a point of time at which the check pattern is printed and controls the nozzle inspection unit so as to perform the nozzle inspection, and subsequently controls the ejection unit so as to resume printing based on the print data and print the check pattern.

2. The printing apparatus according to claim 1, wherein, when the automatic nozzle inspection mode is set, if the check pattern automatic print mode is set while printing based on the print data is being performed, the control unit controls the nozzle inspection unit so as to perform the nozzle inspection before printing of the check pattern when printing of the check pattern is to be performed before printing based on the print data.

3. The printing apparatus according to claim 1, wherein, when the automatic nozzle inspection mode is set, if the check pattern automatic print mode is set while printing based on the print data is being performed, the control unit controls the nozzle inspection unit so as to perform the nozzle inspection before printing based on the print data when printing of the check pattern is to be performed after printing based on the print data.

4. The printing apparatus according to claim 1, wherein the automatic print setting unit sets, as the check pattern automatic print mode, a mode in which, when printing based on the print data is to be performed, the check pattern is printed before or after the print data, together with the print data.

5. The printing apparatus according to claim 1, wherein the check pattern is a pattern that enables confirmation of whether or not the fluid is ejected.

6. A printing apparatus, comprising:

an ejection unit that ejects a fluid from nozzles onto a target;

a nozzle inspection unit that performs nozzle inspection to inspect whether or not the fluid is ejected from the nozzles;

an automatic print setting unit that, when printing based on print data to be printed is to be performed, sets a check pattern automatic print mode in which a check pattern for confirming whether or not the fluid is ejected from the nozzles is printed, together with the print data;

an automatic inspection setting unit that, when a predetermined automatic inspection condition is established, sets an automatic nozzle inspection mode in which the nozzle inspection is performed;

a cleaning unit that, when the result of the nozzle inspection indicates that there is an abnormal nozzle, performs nozzle cleaning to clean the nozzles; and a control unit that, when the automatic nozzle inspection mode is set, if the automatic inspection condition is established while printing based on the print data is being performed in the check pattern automatic print mode, controls the nozzle inspection unit so as not to perform the nozzle inspection during a period from when one of printing based on the print data and printing of the check pattern is started until the other is finished, an instruction input unit that inputs a check pattern print instruction for printing the check pattern, wherein, when the automatic nozzle inspection mode is set, if the check pattern print instruction is input and printing of the check pattern is to be performed separately from printing based on the print data, the nozzle inspection unit is controlled so as not to perform the nozzle inspection even if the automatic inspection condition is established during a period from when the check pattern print instruction is input until the check pattern is printed.

7. The printing apparatus according to claim 6, wherein, when the automatic nozzle inspection mode is set, if the check pattern automatic print mode is set while printing based on the print data is being performed, the control unit controls the nozzle inspection unit so as to perform the nozzle inspection before printing of the check pattern when printing of the check pattern is to be performed before printing based on the print data.

8. The printing apparatus according to claim 6, wherein, when the automatic nozzle inspection mode is set, if the check pattern automatic print mode is set while printing based on the print data is being performed, the control unit controls the nozzle inspection unit so as to perform the nozzle inspection before printing based on the print data when printing of the check pattern is to be performed after printing based on the print data.

9. The printing apparatus according to claim 6, wherein the automatic print setting unit sets, as the check pattern automatic print mode, a mode in which, when printing based on the print data is to be performed, the check pattern is printed before or after the print data, together with the print data.

10. The printing apparatus according to claim 6, wherein the check pattern is a pattern that enables confirmation of whether or not the fluid is ejected.

11. A method of controlling a printing apparatus, which includes an ejection unit for ejecting a fluid from nozzles onto a target, by using computer software, the method comprising:

when the result of a nozzle inspection as to whether or not the fluid is ejected from the nozzles indicates that there is an abnormal nozzle, performing nozzle cleaning to clean the nozzles; and when an automatic nozzle inspection mode in which the nozzle inspection is performed is set while a predetermined automatic inspection condition is established, if the automatic inspection condition is established while printing based on print data is being performed when a check pattern automatic print mode is set in which, when printing based on the print data is performed, a check pattern for confirming whether or not the fluid is ejected from the nozzles is printed, together with the print data, performing control so that the nozzle inspection is not performed during the period from when one of printing based on the print data and printing of the check pattern is started until the other is finished, wherein, when printing based on the print data is to be performed in a state in which the automatic nozzle inspection mode is set, and when a predetermined midstream inspection condition is established while print data consisting of multiple pages is printed, if printing of the check pattern is to be performed before printing based on the print data, the control unit controls the ejection unit so as to pause printing at a point of time at which printing of a page being printed is completed and controls the nozzle inspection unit so as to perform the nozzle inspection, and subsequently controls the ejection unit so as to print the check pattern and resume printing based on the print data, and if printing of the check pattern is to be performed after printing based on the print data, the control unit controls the ejection unit so as to print the check pattern after printing of the page being printed is completed, then controls the ejection unit so as to pause printing at a point of time at which the check pattern is printed and controls the nozzle inspection unit so as to perform the nozzle inspection, and subsequently controls the ejection unit so as to resume printing based on the print data and print the check pattern.

12. The method according to claim 11, wherein, when the automatic nozzle inspection mode is set, if the check pattern automatic print mode is set while printing based on the print data is being performed, the control unit controls the nozzle inspection unit so as to perform the nozzle inspection before printing of the check pattern when printing of the check pattern is to be performed before printing based on the print data.

13. The method according to claim 11, wherein, when the automatic nozzle inspection mode is set, if the check pattern automatic print mode is set while printing based on the print data is being performed, the control unit controls the nozzle inspection unit so as to perform the nozzle inspection before printing based on the print data when printing of the check pattern is to be performed after printing based on the print data.

14. The method according to claim 11, wherein the automatic print setting unit sets, as the check pattern automatic print mode, a mode in which, when printing based on the print data is to be performed, the check pattern is printed before or after the print data, together with the print data.

15. The method according to claim 11, wherein the check pattern is a pattern that enables confirmation of whether or not the fluid is ejected.

16. A method of controlling a printing apparatus, which includes an ejection unit for ejecting a fluid from nozzles onto a target, by using computer software, the method comprising:

when the result of a nozzle inspection as to whether or not the fluid is ejected from the nozzles indicates that there is an abnormal nozzle, performing nozzle cleaning to clean the nozzles;

when an automatic nozzle inspection mode in which the nozzle inspection is performed is set while a predetermined automatic inspection condition is established, if the automatic inspection condition is established while printing based on print data is being performed when a check pattern automatic print mode is set in which, when printing based on the print data is performed, a check pattern for confirming whether or not the fluid is ejected from the nozzles is printed, together with the print data, performing control so that the nozzle inspection is not performed during the period from when one of printing based on the print data and printing of the check pattern is started until the other is finished; and inputting a check pattern print instruction for printing the check pattern, wherein, when the automatic nozzle inspection mode is set, if the check pattern print instruction is input and printing of the check pattern is to be performed separately from printing based on the print data, the nozzle inspection unit is controlled so as not to perform the nozzle inspection even if the automatic inspection condition is established during a period from when the check pattern print instruction is input until the check pattern is printed.

17. The method according to claim 16, wherein, when the automatic nozzle inspection mode is set, if the check pattern automatic print mode is set while printing based on the print data is being performed, the control unit controls the nozzle inspection unit so as to perform the nozzle inspection before printing of the check pattern when printing of the check pattern is to be performed before printing based on the print data.

18. The method according to claim 16, wherein, when the automatic nozzle inspection mode is set, if the check pattern automatic print mode is set while printing based on the print data is being performed, the control unit controls the nozzle inspection unit so as to perform the nozzle inspection before printing based on the print data when printing of the check pattern is to be performed after printing based on the print data.

19. The method according to claim 16, wherein the automatic print setting unit sets, as the check pattern automatic print mode, a mode in which, when printing based on the print data is to be performed, the check pattern is printed before or after the print data, together with the print data.

20. The method according to claim 16, wherein the check pattern is a pattern that enables confirmation of whether or not the fluid is ejected.

* * * * *